US006611103B2

(12) United States Patent
Murakami

(10) Patent No.: US 6,611,103 B2
(45) Date of Patent: Aug. 26, 2003

(54) ELECTRON GUN ASSEMBLY FOR CATHODE RAY TUBE

(75) Inventor: Fumiaki Murakami, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/120,549

(22) Filed: Apr. 12, 2002

(65) Prior Publication Data

US 2002/0195944 A1 Dec. 26, 2002

(30) Foreign Application Priority Data

Jun. 11, 2001 (JP) ..... 2001-175417

(51) Int. Cl.[7] ..... H01J 25/10; H01J 29/50

(52) U.S. Cl. ..... 315/5.39; 315/382; 315/368.16; 315/370; 313/414; 313/412

(58) Field of Search ..... 315/368.16, 382, 315/382.1, 5.39, 5.41, 370; 313/414, 412, 413, 421, 426

(56) References Cited

U.S. PATENT DOCUMENTS 5,898,260 A * 4/1999 Misono ..... 313/414
6,255,767 B1 * 7/2001 Lee et al. ..... 313/414
6,456,017 B1 * 9/2002 Bae et al. ..... 315/369
6,472,808 B1 * 10/2002 Uchida et al. ..... 313/414

FOREIGN PATENT DOCUMENTS

JP 57-118352 A 7/1982

* cited by examiner

*Primary Examiner*—Don Wong
*Assistant Examiner*—Tuyet T Vo
(74) *Attorney, Agent, or Firm*—Birch, Stewart, Kolasch & Birch, LLP

(57) ABSTRACT

An electron gun assembly for a CRT includes three cathode electrodes, a control electrode, an electron-stream extractor electrode, a focusing electrode, and an anode electrode. The electron-stream extractor electrode includes first, second, and third holes, each of which allows one of the three streams of the electrons to pass through. The focusing electrode includes a flat portion having fourth, fifth, and sixth holes, each of which allows one of the three streams of the electrons to pass through. The first, second, and third holes are arranged in the in-line direction. Each of the fourth and sixth holes includes a substantially rectangular opening and a substantially semicircular opening connected to each other. One side of the substantially rectangular opening is connected to a straight line segment of the substantially semicircular opening, and the substantially rectangular opening is disposed outside while the substantially semicircular opening is disposed inside.

8 Claims, 5 Drawing Sheets

ELECTRON GUN ASSEMBLY FOR CATHODE RAY TUBE

BACKGROUND OF THE INVENTION

The present invention relates to an electron gun assembly for a cathode ray tube (CRT), and is particularly concerned with shapes of an electron-stream extractor electrode (namely, accelerating electrode) and a focusing electrode.

In general, an electron gun assembly for a CRT is assembled in the following procedures. First, cathode electrodes each formed into a plate-like shape, tube-like shape, cap-like shape, or the like, a control electrode, an electron-stream extractor electrode, a focusing electrode, and an anode electrode are laid on one another with spacers placed in between. Next, a surface with holes of the focusing electrode (Each of the holes allows a stream of the electrons to pass through.) is placed on a reference position. This is because a position of the surface with holes of the focusing electrode would have the greatest effect on the performance of the electron gun assembly. Next, pressure is applied from the side of a three-electrode portion (the cathode electrodes, the control electrode, and the electron-stream extractor electrode) and from the side of the main lens (the focusing electrode). Then, the periphery of these electrodes is secured by heated glass material such as multiform glass of Asahi Glass Corporation.

FIG. 6 to FIG. 9 show the electron-stream extractor electrode 30 and the focusing electrode 40 described above. FIG. 6 is a horizontal sectional view showing the electron-stream extractor electrode 30 and the focusing electrode 40, and FIG. 7 is a vertical sectional view taken along a line $S_6$—$S_6$ of FIG. 6. Moreover, FIG. 8 is a front view of the electron-stream extractor electrode 30 when viewed from the focusing electrode 40, and FIG. 9 is a front view of the focusing electrode 40 when viewed from the electron-stream extractor electrode 30.

As shown in the figures, the electron-stream extractor electrode 30 has holes 31, 32, and 33, each of which allows a stream of the electrons (namely, an electron beam) to pass through, and which are arranged in an in-line direction (X direction). Further, the electron-stream extractor electrode 30 has circular depressions 34, 35, and 36 that are formed around the holes 31, 32, and 33 by the coining process. The depression 34 is formed in such a place that a center position is disposed inside a center position of the hole 31. The depression 36 is formed in such a place that a center position is disposed inside a center position of the hole 33. In addition, as shown in the figures, the focusing electrode 40 has holes 41, 42, and 43, each of which allows the stream of the electrons to pass through, and which are arranged in the in-line direction. The holes 41, 42, and 43 are formed at the bottom of the rectangular depressed portions 44, 45, and 46 made by the drawing process, each of which functions as a quadrupole lens.

The electron-stream extractor electrode 30 and the focusing electrode 40 described above form electrostatic lenses, as indicated by broken lines in FIG. 6, which adjust the traveling directions (courses) and the cross sectional shapes of the electron beams. The courses of the electron beams can be adjusted by changing the center positions of the depressions 34 and 36, and the shapes of the electron beams can be adjusted by changing the width and length (namely, aspect ratio) of the rectangular depressed portions 44, 45, and 46 respectively.

As has been described above, in the conventional electron gun assembly, the bottoms of the rectangular depressed portions 44, 45, and 46 of the focusing electrode 40 are used as the reference positions when the electrodes are assembled. However, the drawing process for forming the rectangular depressed portions 44, 45, and 46 produces slight machining variations in depth, position, and size of the bottoms of the rectangular depressed portions 44, 45, and 46, depending on the product. Accordingly, it has been difficult to reduce variations in performance depending on the product, resulting from machining errors of the conventional electron gun assembly.

SUMMARY OF THE INVENTION

It is an object of the present invention to provide an electron gun assembly for a CRT that can reduce variations in performance depending on the product, resulting from machining variations.

According to the present invention, an electron gun assembly for a CRT includes: at least one cathode electrode which emits electrons; a control electrode which controls traveling directions of the electrons emitted from the cathode electrode, thereby producing three streams of the electrons; an electron-stream extractor electrode which accelerates the three streams of the electrons; a focusing electrode which focuses the three streams of the electrons accelerated by the electron-stream extractor electrode; and an anode electrode which accelerates the three streams of the electrons focused by the focusing electrode. The electron-stream extractor electrode includes first, second, and third holes, each of which allows one of the three streams of the electrons produced by the control electrode to pass through. The focusing electrode includes a surface which faces the electron-stream extractor electrode, the surface including fourth, fifth, and sixth holes, each of which allows one of the three streams of the electrons accelerated by the electron-stream extractor electrode to pass through, the fourth, fifth, and sixth holes facing the first, second, and third holes, respectively. At least one of the fourth, fifth, and sixth holes of the focusing electrode includes a substantially rectangular opening and a substantially semicircular opening, one side of the substantially rectangular opening being connected to a straight line segment of the substantially semicircular opening.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Further scope of applicability of the present invention will become apparent from the detailed description given hereinafter. However, it should be understood that the detailed description and specific examples, while indicating preferred embodiments of the invention, are given by way of illustration only, since various changes and modifications will become apparent to those skilled in the art from the detailed description.

Figure 1:
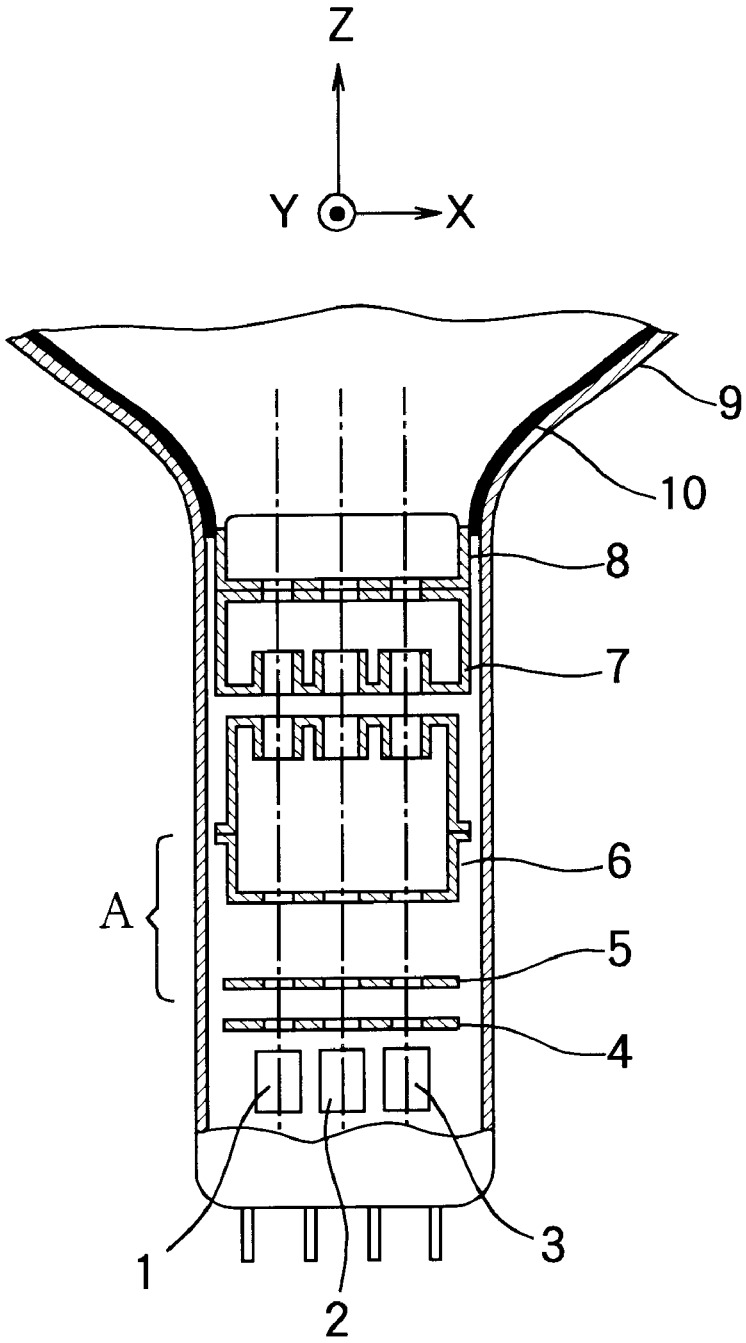
FIG. 1 is a horizontal sectional view schematically showing an electron gun assembly for a CRT in accordance with an embodiment of the present invention.

FIG. 1 is a horizontal sectional view schematically showing an electron gun assembly for a CRT in accordance with an embodiment of the present invention. As shown in FIG. 1, the electron gun assembly in accordance with this embodiment has cathode electrodes 1, 2, and 3 which are arranged in an in-line direction, and a control electrode 4 which controls traveling directions of electrons emitted from the cathode electrodes 1, 2, and 3, thereby producing three streams of the electrons. Further, the electron gun assembly has an electron-stream extractor electrode 5 which accelerates the three streams of the electrons controlled by the control electrode 4, and a focusing electrode 6 which focuses the three streams of the electrons accelerated by the electron-stream extractor electrode 5 and is disposed to oppose the electron-stream extractor electrode 5. Furthermore, the electron gun assembly has an anode electrode 7 which accelerates the three streams of the electrons (that is, three electron beams) focused by the focusing electrode 6, and a shield cup 8 connected to the anode electrode 7. In FIG. 1, a reference numeral 9 denotes an envelope of the CRT, and a reference numeral 10 denotes conductive coating provided on an inner surface of the envelope 9. Further, a symbol X denotes the in-line direction orthogonal to a tube axis of the CRT (X normally denotes a horizontal direction of the installed CRT), a symbol Y denotes a direction orthogonal to the in-line direction (Y denotes a direction from the back to the front of the paper on which FIG. 1 is drawn, or Y normally denotes a vertical direction of the installed CRT), and a symbol Z denotes a direction parallel to the tube axis of the CRT.

Figure 2:
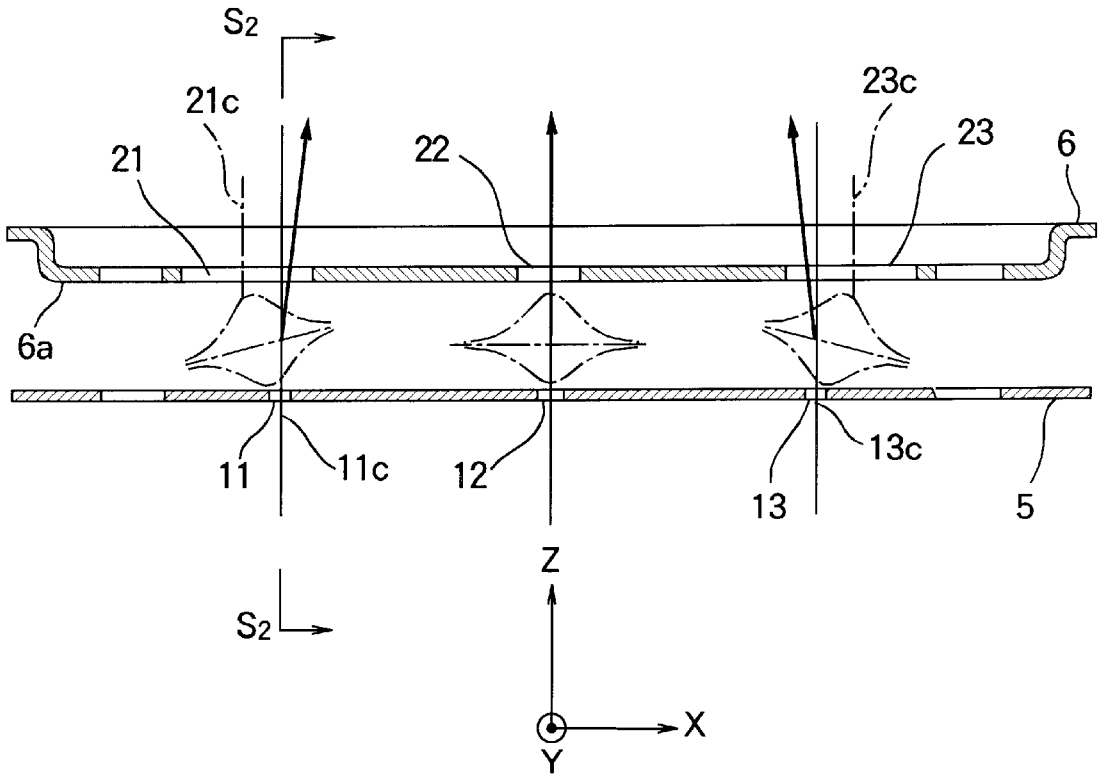
FIG. 2 is a horizontal sectional view showing a portion "A" of FIG. 1 on an enlarged scale.
Figure 3:
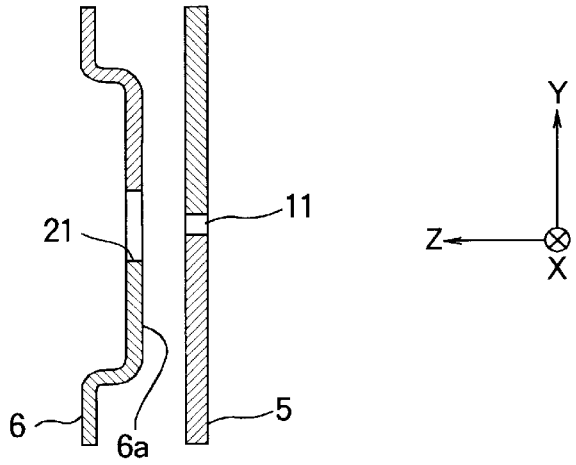
FIG. 3 is a vertical sectional view taken along a line $S_2$—$S_2$ of FIG. 2.

FIG. 2 is a horizontal sectional view showing the electron-stream extractor electrode 5 and a part of the focusing electrode 6 (a portion "A" of FIG. 1) on an enlarged scale, and FIG. 3 is a vertical sectional view taken along a line $S_2$—$S_2$ of FIG. 2. Moreover, FIG. 4 is a front view of the electron-stream extractor electrode 5 when viewed from the focusing electrode 6, and FIG. 5 is a front view of the focusing electrode 6 when viewed from the electron-stream extractor electrode 5.

Figure 4:
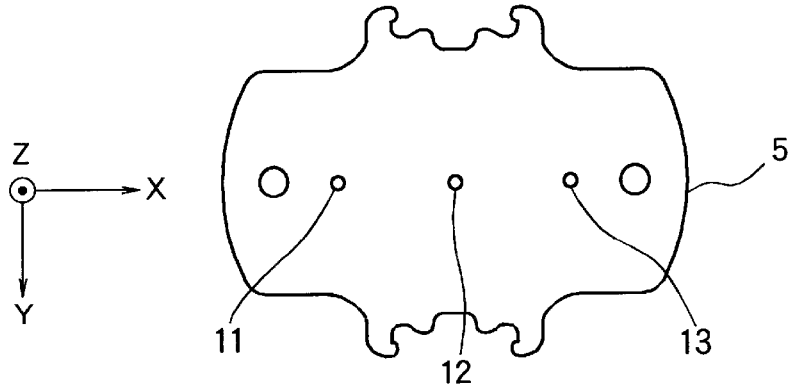
FIG. 4 is a front view of an electron-stream extractor electrode of FIG. 1 when viewed from the focusing electrode.

As shown in FIG. 2 to FIG. 4, the electron-stream extractor electrode 5 has first, second, and third holes 11, 12, and 13, each of which allows one of the three streams of the electrons to pass through, and which are arranged in the in-line direction. The electron-stream extractor electrode 5 includes a flat plate portion, and the first, second, and third holes 11, 12, and 13 are formed in the flat plate portion. In FIG. 2, the whole of the electron-stream extractor electrode 5 consists of the flat plate portion with holes 11, 12, and 13, but the whole of the electron-stream extractor electrode 5 may not always be the flat plate portion. In addition, the first, second, and third holes 11, 12, and 13 are circular and have the same internal diameter. However, the internal diameters and shapes of the first, second, and third holes 11, 12, and 13 may be different in size and shape as long as they are determined in accordance with the characteristics required for the electron gun assembly.

Figure 5:
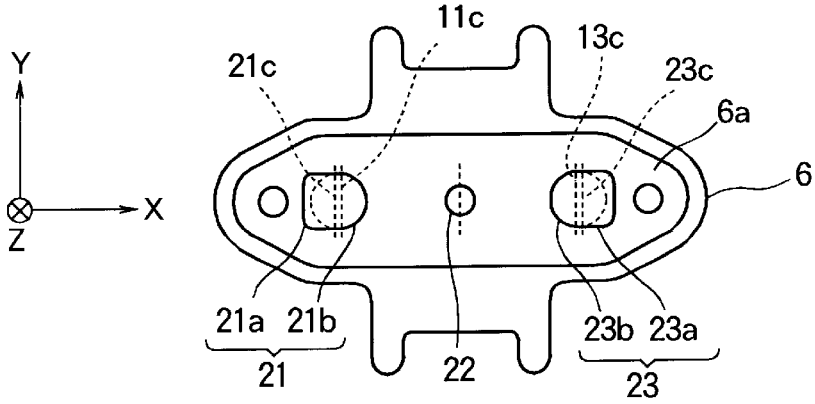
FIG. 5 is a front view of the focusing electrode of FIG. 1 when viewed from the electron-stream extractor electrode.

Further, as shown in FIG. 2, FIG. 3, and FIG. 5, the surface of the focusing electrode 6 facing the electron-stream extractor electrode 5 has the flat portion 6*a*. In the flat portion 6*a*, fourth, fifth, and sixth holes 21, 22, and 23, each of which allows one of the streams of the electrons to pass through, are formed. The fourth, fifth, and sixth holes 21, 22, and 23 are disposed to oppose respectively the first, second, and third holes 11, 12, and 13 of the electron-stream extractor electrode 5. In addition, as shown in FIG. 5, each of the fourth and sixth holes 21 and 23 includes a substantially rectangular opening 21*a* or 23*a* and a substantially semicircular opening 21*b* or 23*b* connected to each other. One side of the substantially rectangular opening 21*a* or 23*a* and a straight line segment of the substantially semicircular opening 21*b* or 23*b* are connected to each other. The substantially rectangular openings 21*a* and 23*a* are disposed outward while the substantially semicircular openings 21*b* and 23*b* are disposed inward. Moreover, the fifth hole 22 of the focusing electrode 6 has a circular shape. However, the shape of the fourth and sixth holes 21 and 23 of the focusing electrode 6 may be different from that shown in FIG. 5. For instance, the substantially semicircular openings 21*b* and 23*b* may not be completely semicircular, as formed by cutting a circle along a line passing the center point, and may have the shape of a segment formed by cutting a circle along a line which does not pass the center point. In addition, the arc portion of the substantially semicircular openings 21*b* and 23*b* may be a part of an ellipse. Furthermore, the shape of the substantially rectangular openings 21*a* and 23*a* may be a square, rectangle, or trapezoid. Moreover, the fifth hole 22 of the focusing electrode 6 is formed in circular shape, and is formed so that a diameter becomes smaller than a width in the Y direction of the fourth and sixth holes 21 and 23 of the focusing electrode 6.

In addition, as shown in FIG. 2 and FIG. 5, the focusing electrode 6 is formed in such a way that a center position 21*c* in the X direction of the fourth hole 21 is disposed outside a center position 11*c* in the X direction of the first hole 11 of the electron-stream extractor electrode 5. Further, the focusing electrode 6 is formed in such a way that a center position 23*c* in the X direction of the sixth hole 23 is disposed outside a center position 13*c* in the X direction of the third hole 13 of the electron-stream extractor electrode 5.

Figure 8:
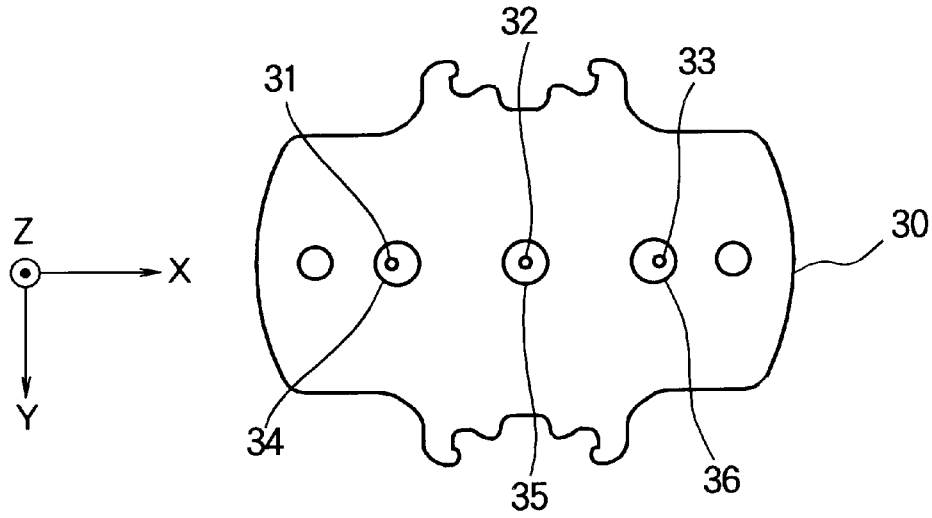
FIG.8 CONVENTIONAL ART
FIG. 8 is a front view of an electron-stream extractor electrode of FIG. 6 when viewed from the focusing electrode.
Figure 9:
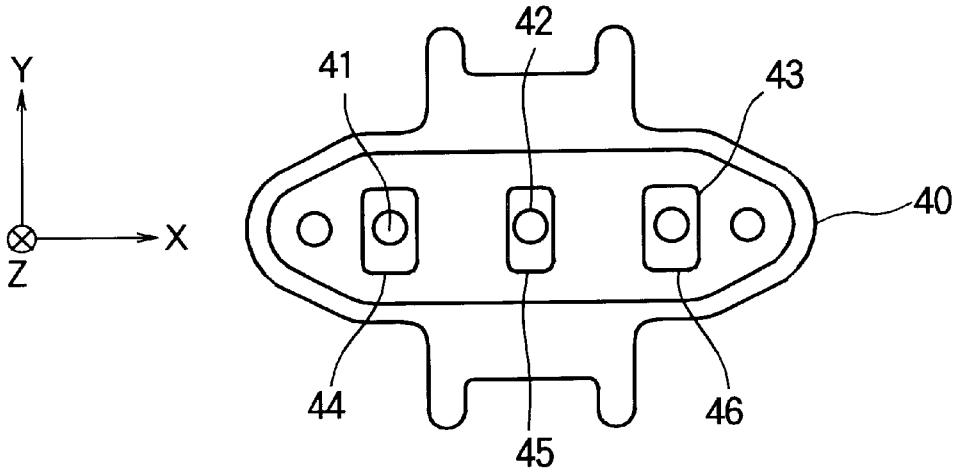
FIG.9 CONVENTIONAL ART
FIG. 9 is a front view of the focusing electrode shown of FIG. 6 when viewed from the electron-stream extractor electrode.

In the electron gun assembly configured as described above in accordance with this embodiment, the substantially rectangular openings 21*b* and 23*b* of the holes 21 and 23 of the focusing electrode 6 play the role of the rectangular depressed portion (rectangular depressed portions 44 and 46 in FIG. 6 and FIG. 9) of the conventional focusing electrode. Moreover, in the electron gun assembly in accordance with this embodiment, the role of the eccentricity of the depression made by the coining process in the conventional electron-stream extractor electrode (eccentricity of the depressions 34 and 36 and the holes 31 and 33 in FIG. 6 and FIG. 8) is played by the departure of the center position 21*c* of the fourth hole 21 from the center position 11*c* of the first hole 11 and the departure of the center position 23*c* of the sixth hole 23 from the center position 13*c* of the third hole 13, shown in FIG. 2 and FIG. 5.

In other words, in the electron gun assembly in accordance with this embodiment, the effect of a quadrupole lens can be modified, and the cross sectional shape of the electron beam can be adjusted, by changing the shapes (ratio of the width to the length, for instance) of the substantially rectangular openings 21*b* and 23*b* of the holes 21 and 23 of the focusing electrode 6. Moreover, in the electron gun assembly in accordance with this embodiment, the traveling direction (course) of the electron beam can be adjusted by changing the length in the X direction of the substantially rectangular openings 21*b* and 23*b* of the holes 21 and 23 of the focusing electrode 6 and thereby shifting the center positions 21*c* and 23*c* in the X direction. Accordingly, the electron gun assembly in accordance with this embodiment can adjust the traveling direction and cross sectional shape of the electron beam without providing an rectangular depressed portion (rectangular depressed portions 44 and 46 of FIG. 6 and FIG. 9) in the focusing electrode or a depression (depressions 34 and 36 of FIG. 6 and FIG. 8) in the electron-stream extractor electrode, as in the conventional art. Therefore, in the electron gun assembly in accordance with this embodiment, the holes 21, 22, and 23 can be formed in the flat portion 6*a* of the focusing electrode 6.

As has been described above, the electron gun assembly in accordance with this embodiment does not require the machining process such as the drawing process and the coining process, which is required in the conventional electron gun assembly having holes formed in the rectangular depressed portion, so that the electron-stream extractor electrode 5 and the focusing electrode 6 can be formed in a simplified shape, which makes it possible to reduce the manufacturing costs. In addition, because the holes 21, 22, and 23 are formed in the flat portion 6*a* of the electron gun assembly in accordance with this embodiment, the electrodes 1 to 8 can be assembled with the flat portion 6*a* as a reference position, which has small machining errors and a large area. Accordingly, variations in performance depending on the assembled product, resulting from machining errors, can be reduced.

An electron gun assembly of the in-line type has been described above, but in an electron gun assembly of another type, the traveling directions and shapes of the electron beams can be adjusted by forming the hole, which allows the electron beam to pass through, of the focusing electrode in the shape made by butting one side of a substantially rectangular opening and the straight line segment of a substantially semicircular opening.

Figure 6:
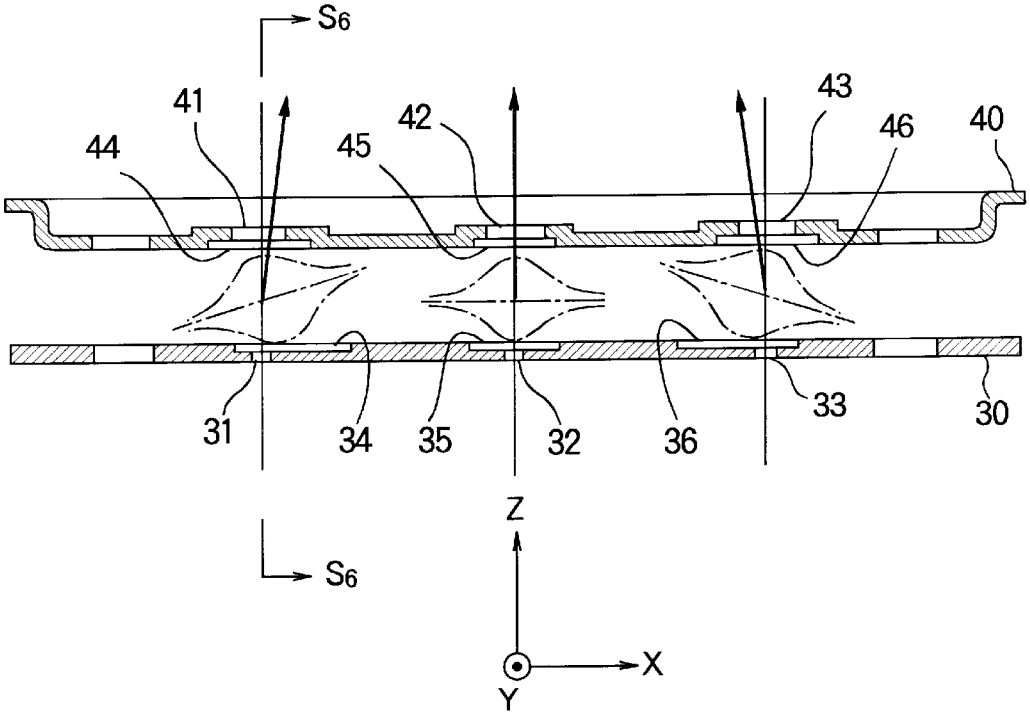
FIG. 6 CONVENTIONAL ART
FIG. 6 is a horizontal sectional view showing the conventional electron-stream extractor electrode and focusing electrode.
Figure 7:
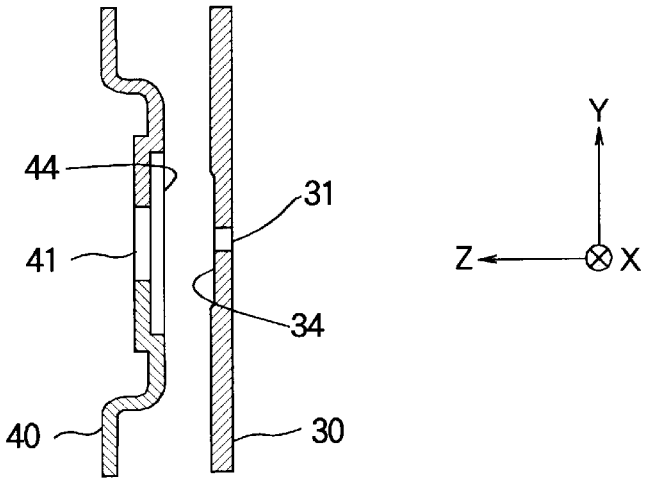
FIG. 7 CONVENTIONAL ART
FIG. 7 is a vertical sectional view taken along a line $S_6$—$S_6$ of FIG. 6.

An example without depressions in the electron-stream extractor electrode has been described above, but the focusing electrode of this embodiment (the focusing electrode 6 with the holes through which the electron beam passes 21 and 23, shown in FIG. 2) may be applied to the electron-stream extractor electrode configured with depressions (the electron-stream extractor electrode 30 of FIG. 6).

The invention being thus described, it will be obvious that the same may be varied in many ways. Such variations are not to be regarded as a departure from the spirit and scope of the invention, and all such modifications as would be obvious to one skilled in the art are intended to be included within the scope of following claims.

What is claimed is:

1. An electron gun assembly for a cathode ray tube comprising:

at least one cathode electrode which emits electrons;

a control electrode which controls traveling directions of the electrons emitted from said cathode electrode, thereby producing three streams of the electrons;

an electron-stream extractor electrode which accelerates said three streams of the electrons;

a focusing electrode which focuses said three streams of the electrons accelerated by said electron-stream extractor electrode; and an anode electrode which accelerates said three streams of the electrons focused by said focusing electrode;

wherein said electron-stream extractor electrode includes first, second, and third holes, each of which allows one of said three streams of the electrons produced by said control electrode to pass through;

wherein said focusing electrode includes a surface which faces said electron-stream extractor electrode, said surface including fourth, fifth, and sixth holes, each of which allows one of said three streams of the electrons accelerated by said electron-stream extractor electrode to pass through, said fourth, fifth, and sixth holes facing said first, second, and third holes, respectively;

wherein at least one of said fourth, fifth, and sixth holes of said focusing electrode includes a substantially rectangular opening and a substantially semicircular opening, one side of said substantially rectangular opening being connected to a straight line segment of said substantially semicircular opening.

2. The electron gun assembly according to claim 1, wherein said electron-stream extractor electrode includes a first flat portion, and said first, second, and third holes of said electron-stream extractor electrode are formed in said first flat portion.

3. The electron gun assembly according to claim 1, wherein said first, second, and third holes of said electron-stream extractor electrode are circular.

4. The electron gun assembly according to claim 1, wherein said surface of said focusing electrode is a second flat portion which faces a first flat portion of said electron-stream extractor electrode, and said fourth, fifth, and sixth holes of said focusing electrode are formed in said second flat portion.

5. The electron gun assembly according to claim 1, wherein said at least one cathode electrode includes three cathode electrodes arranged in an in-line direction orthogonal to a tube axis of the cathode ray tube;

wherein said first, second, and third holes of said electron-stream extractor electrode are arranged in the in-line direction; and wherein each of said fourth and sixth holes of said focusing electrode includes a substantially rectangular opening and a substantially semicircular opening, one side of said substantially rectangular opening being connected to a straight line segment of said substantially semicircular opening, said substantially rectangular opening being disposed outside, said substantially semicircular opening being disposed inside.

6. The electron gun assembly according to claim 5, wherein a center position in the in-line direction of said fourth hole of said focusing electrode is disposed outside a center position of said first hole of said electron-stream extractor electrode, and a center position in the in-line direction of said sixth hole of said focusing electrode is disposed outside a center position of said third hole of said electron-stream extractor electrode.

7. The electron gun assembly according to claim 5, wherein said fifth hole of said focusing electrode is circular.

8. The electron gun assembly according to claim 5, wherein a diameter of said fifth hole of said focusing electrode is smaller than a width in a direction orthogonal to the in-line direction of said fourth and sixth holes of said focusing electrode.

* * * * *